United States Patent [19]

Jurgensen

[11] Patent Number: 4,912,892

[45] Date of Patent: Apr. 3, 1990

[54] UNITIZED MODULE FOR ROOM ADDITION

[75] Inventor: Bruce A. Jurgensen, Forest Grove, Oreg.

[73] Assignee: Zantel, Inc., Forest Grove, Oreg.

[21] Appl. No.: 276,214

[22] Filed: Nov. 23, 1988

[51] Int. Cl.[4] ..... E04B 1/344

[52] U.S. Cl. ..... 52/69; 52/71; 296/26

[58] Field of Search ..... 52/67, 64, 71, 69; 296/26, 21, 22, 165

[56] References Cited

U.S. PATENT DOCUMENTS 3,292,971 12/1966 Zucker ..... 52/64 X
4,633,626 1/1987 Freeman et al. ..... 52/71
4,689,924 9/1987 Jurgensen ..... 52/71 X

FOREIGN PATENT DOCUMENTS 290795 3/1967 Australia ..... 52/67

*Primary Examiner*—Carl D. Friedman
*Attorney, Agent, or Firm*—Robert L. Harrington

[57] ABSTRACT

A unitized module that includes a fully operable self-contained add on room that is adapted to be fitted into the wall of any core structure. The roof, walls and floor of the add on room are confined in a surrounding frame. Motors, including extendable pistons are housed in the frame. The roof, walls and floor are pivotally attached to the frame and pivotally deployed by the motors. The motors are extended between the walls, roof and floor and the frame for pivoting of the walls, roof and floor relative to the frame. The motors are mounted so as to be retracted into the confines of the frame with the add on room collapsed inside the frame.

5 Claims, 6 Drawing Sheets

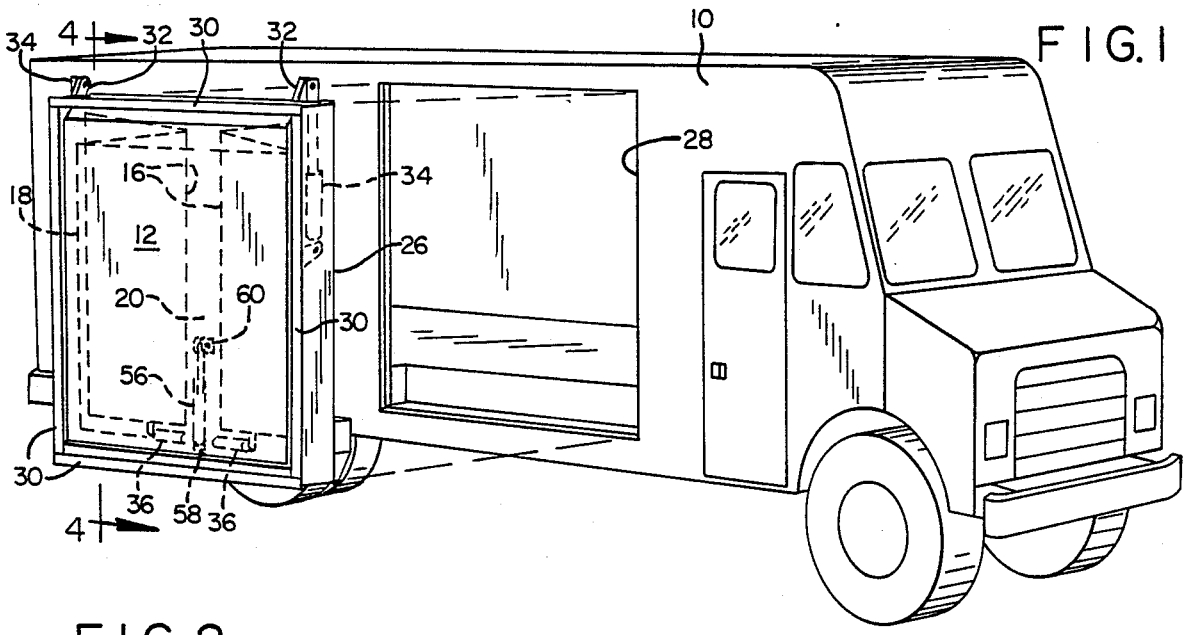
FIG. 1
FIG. 2
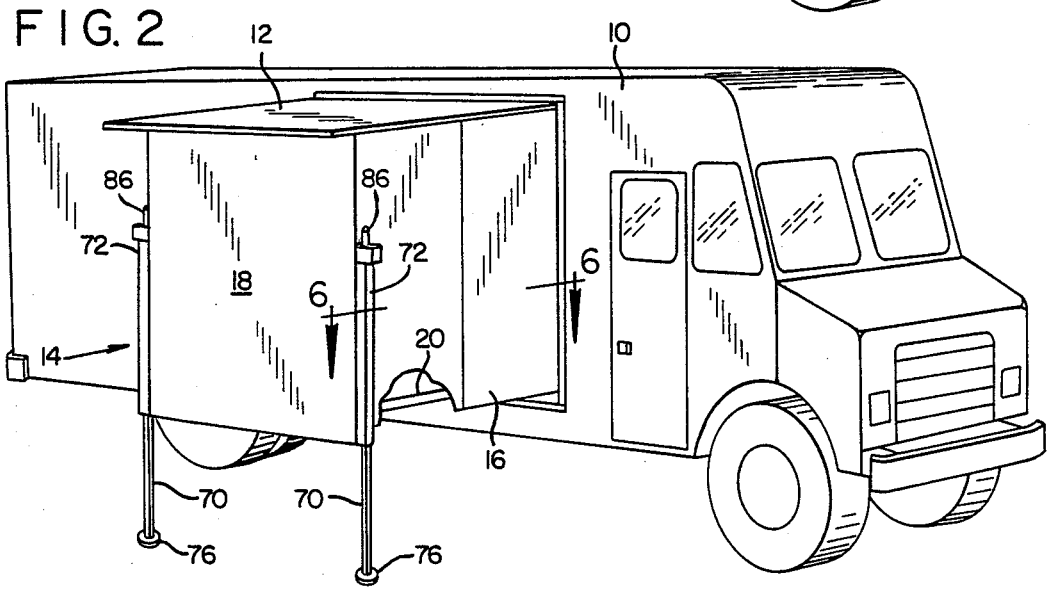
FIG. 3
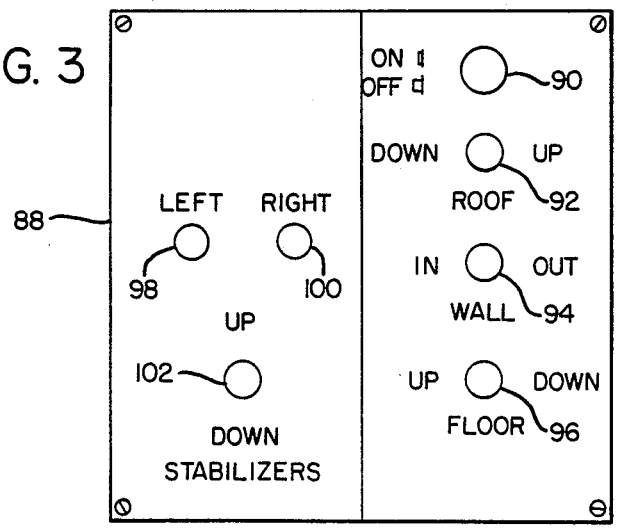

UNITIZED MODULE FOR ROOM ADDITION

FIELD OF INVENTION

This invention relates to a structure that extends out of a core member to provide a room addition, and more particularly to a self-contained structure adapted to be mounted to the core member as a unitized module, including the mechanism for accomplishing the expansion and conversion to the room addition.

BACKGROUND OF THE INVENTION

An expandable wall section providing a room addition for a motorized van or the like, is not novel. Several patents describing the basic concept have issued including the commonly assigned U.S. Pat. Nos. 4,683,677 and 4,689,924. The disclosures of British Patent No. 699,753 and Australian Patent No. 290,795 are also of interest. However, a major revision to the core structure is required to achieve powered deployment.

The need for the expandable wall sections has developed out of the increasing popularity of mobile recreational vehicles, mobile medical vans, mobile display booths, etc. Any kind of a core structure that is to be pulled over the Nation's highways is restricted in width. Any time that the ultimate use of that core structure is more suited to a width exceeding the road width limit (and the situations are innumerable), the expandable wall concept of the above-cited patents is desirable.

BRIEF DESCRIPTION OF THE PRESENT INVENTION

The present invention is directed to a concept of providing an expandable wall section as a self-contained or unitized module. The entire structure that makes up the room addition, i.e. the walls, floor and roof, the hinges and supports therefor, and the actuating motors for opening and closing the room addition, are all supported or housed in a frame and the combination makes up the unitized module.

The outside configuration of the frame is essentially rectangular shaped. The wall member of the core structure in which the module is to be mounted, must simply accommodate the dimensions of the outside configuration of the frame. An opening of the appropriate dimensions is provided in the wall member and the unitized module inserted and secured in place. The electrical wires to a control panel and from a power source are the only hookups required and the expandable room addition is ready to use.

Pushing control buttons activates a sequence of motorized operations including lifting of the expandable room's roof, extension of the expandable room's side walls and unfolding of the end walls thereof, lowering the expandable room's floor and setting of stabilizers.

The invention will be more fully understood and appreciated with reference to the following detailed description including the drawings wherein;

FIG. 1 is a perspective view of a collapsed unitized module being mounted to a core unit, with components thereof shown in dash lines to illustrate the general arrangement of the components;

FIG. 2 is a prospective view of the unitized module of FIG. 1 in its expanded condition and as mounted in the core structure of a van;

FIG. 3 is a schematic illustration of a control panel as provided in the cab of the van of FIG. 2 for converting the module from collapsed to expanded condition and vice versa;

Figure 6:
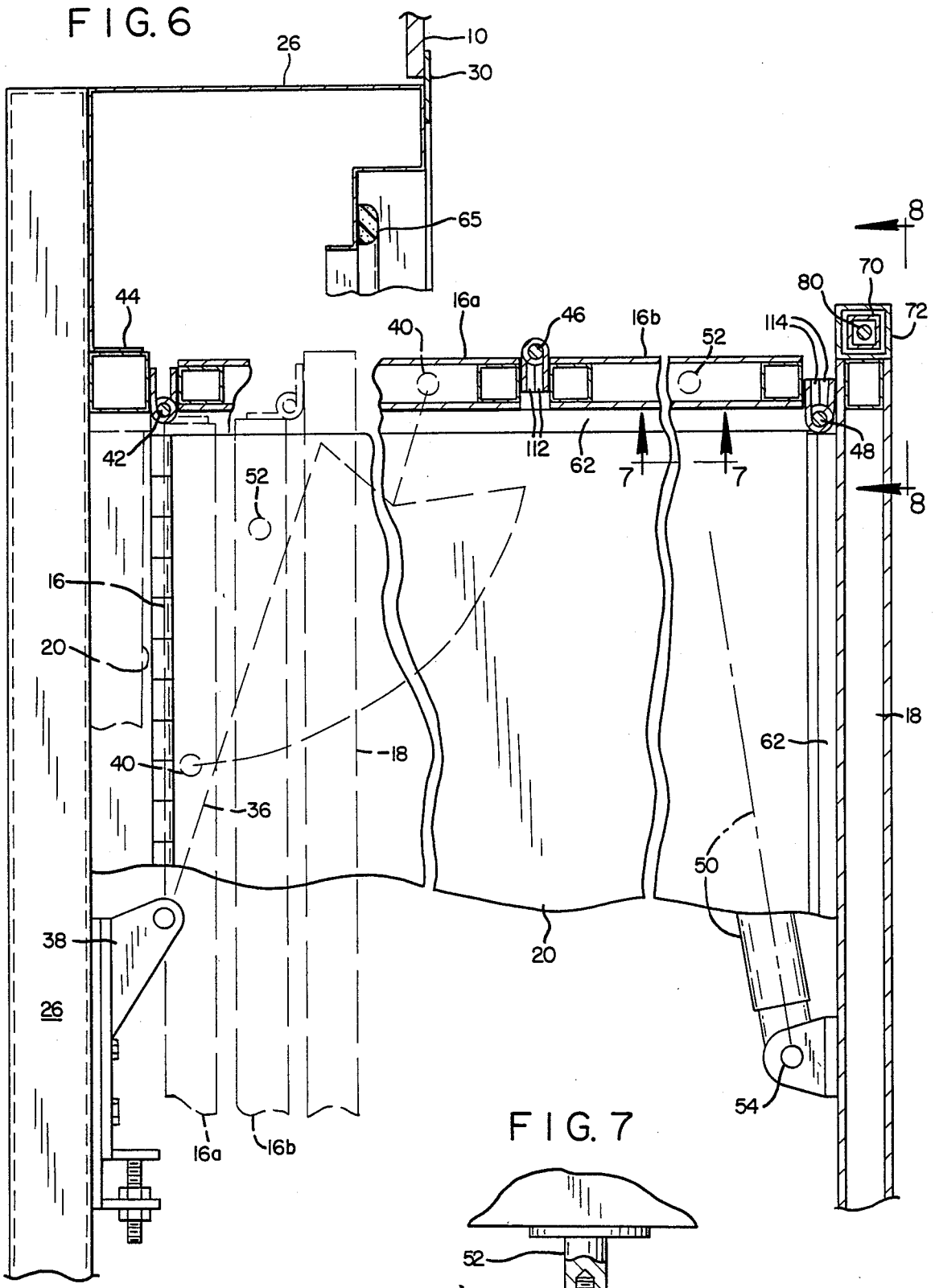
FIG. 6 is a section view as taken on view lines 6—6 of FIG. 2.
Figure 8:
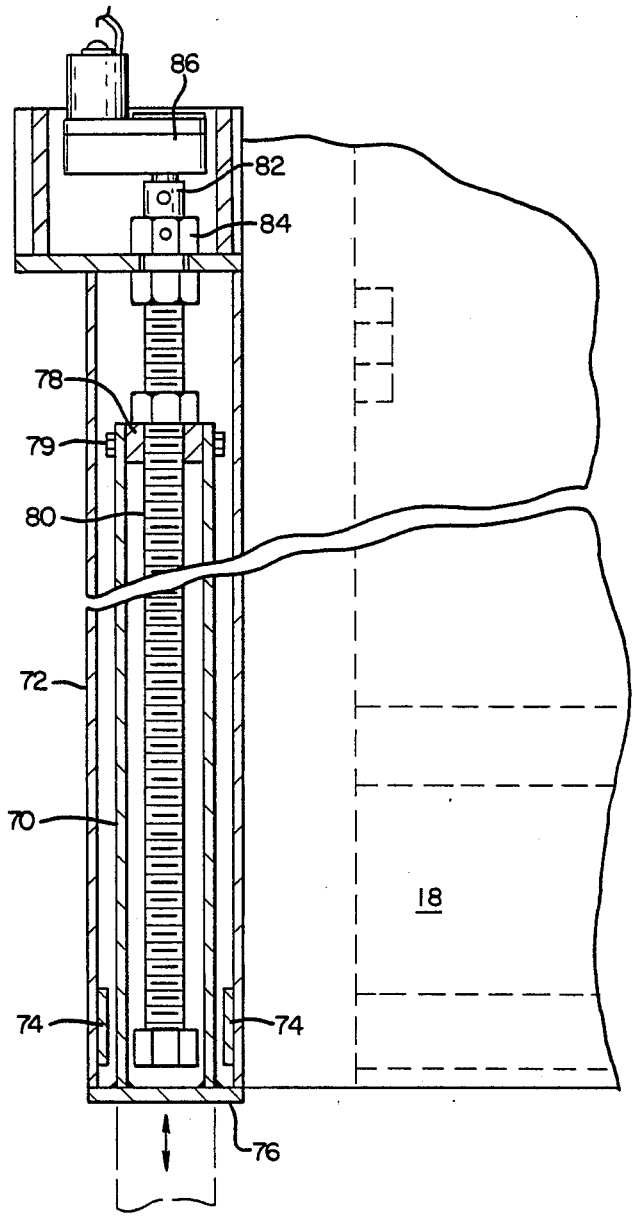
Figure 9:
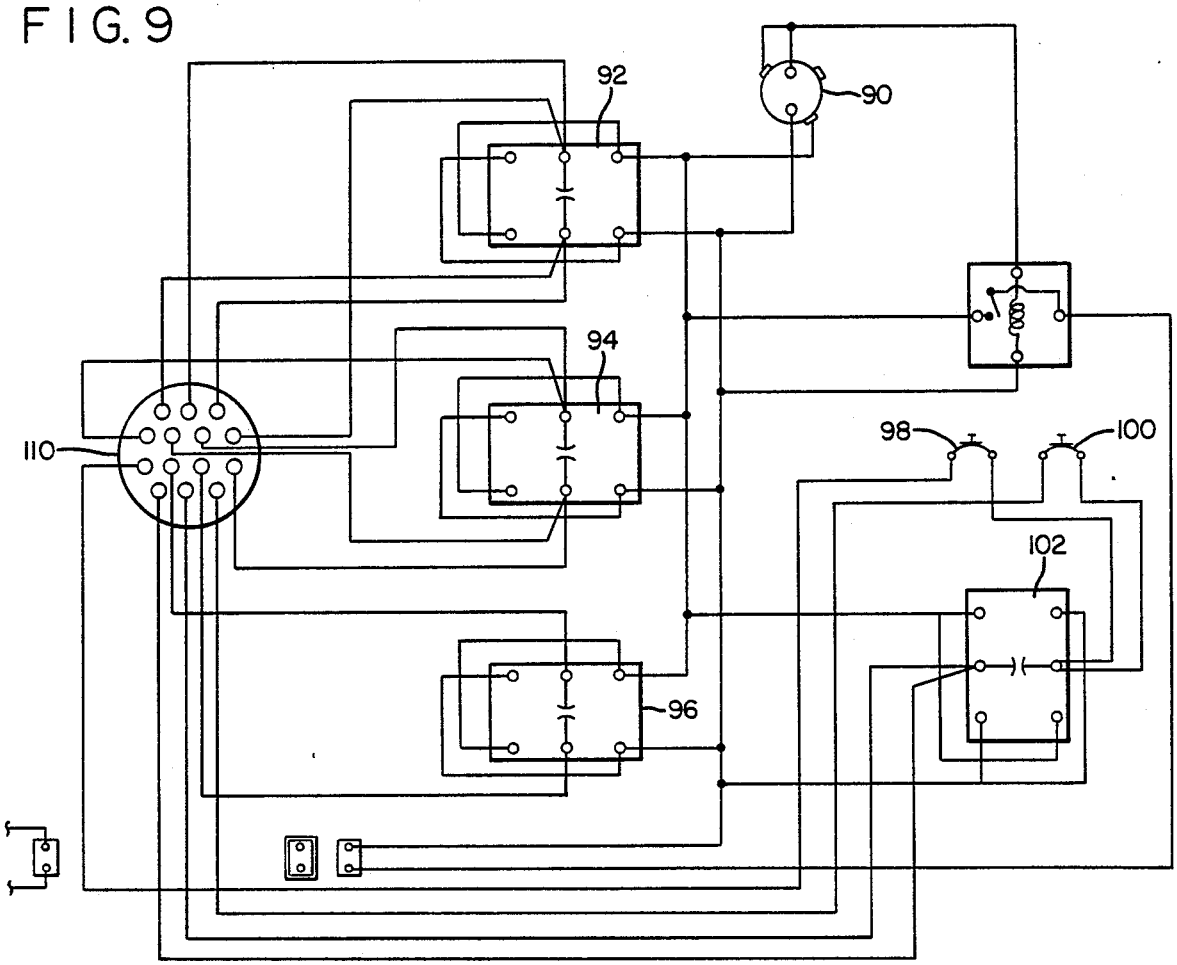
Figure 10:
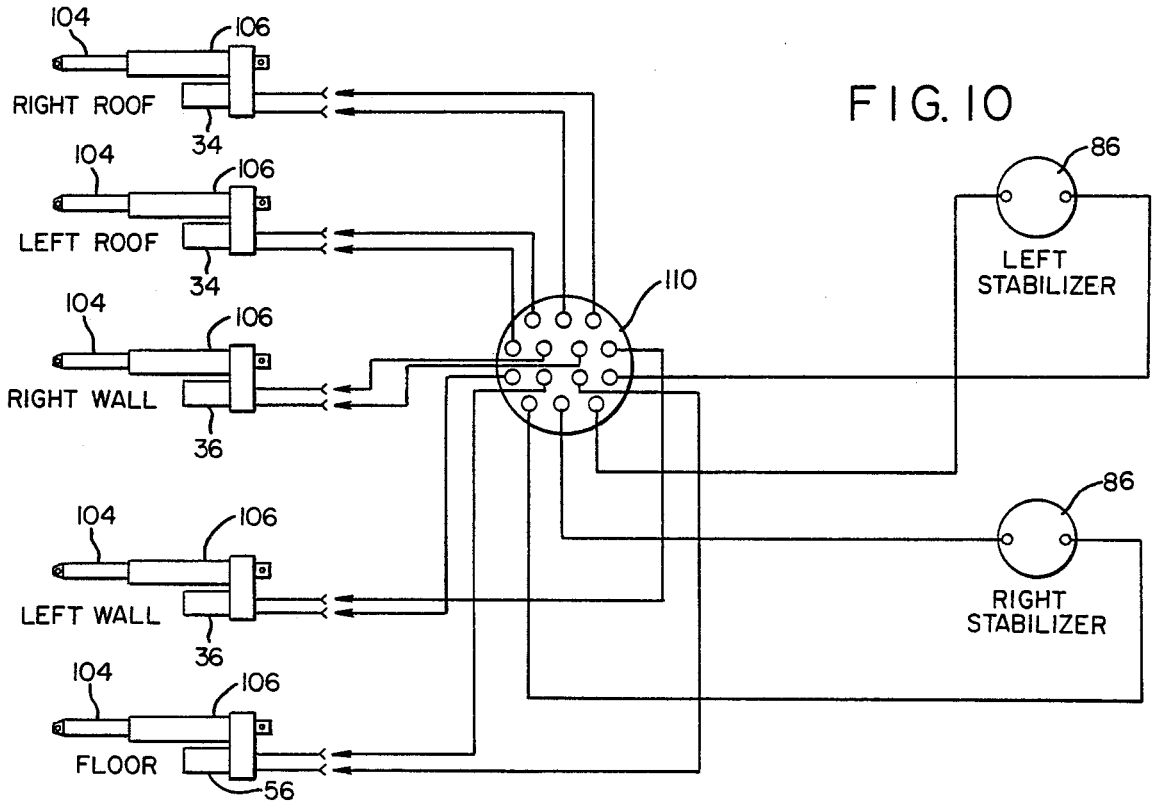

FIG. 8 is a view of the stabilizers as taken on section lines 8—8 of FIGS. 1 and 6; and FIGS. 9 and 10 are schematic diagrams of the electronic controls for controlling the conversion of the module as between its collapsed and expanded conditions.

With reference to FIGS. 1 and 2 of the drawings, the concept of the expandable room requires a support wall 10 (the previously referred to wall member) that is large enough to accommodate the dimensions of a fold out wall/roof 12. In the folded or collapsed condition of FIG. 1, the wall/roof 12 is inset and becomes a part of the support wall 10. In the unfolded or expanded condition of FIG. 2, the wall/roof 12 becomes the roof of the add on room generally designated by referenced number 14. The add on room 14, in addition to the wall/roof 12, includes opposed end walls 16, (each end wall is a bi-fold wall comprised of two sections 16*a*, 16*b*, only one end wall being shown in FIG. 2) a side wall 18 and a floor 20 (shown through the breakaway section of bi-fold wall 16 in FIG. 2).

The sequence of operations for deploying the add on room 14 will be explained in general. (The collapsing sequence is simply a reversal of the fold-out sequence.) The reader may wish to refer to FIGS. 4 and 5 as an aid to an understanding of the sequence, noting that FIG. 4 is a sectional view of the walls in the collapsed condition from FIG. 1 and FIG. 5 is a similar view but of the expanded condition as shown in FIG. 2.

Figure 4:
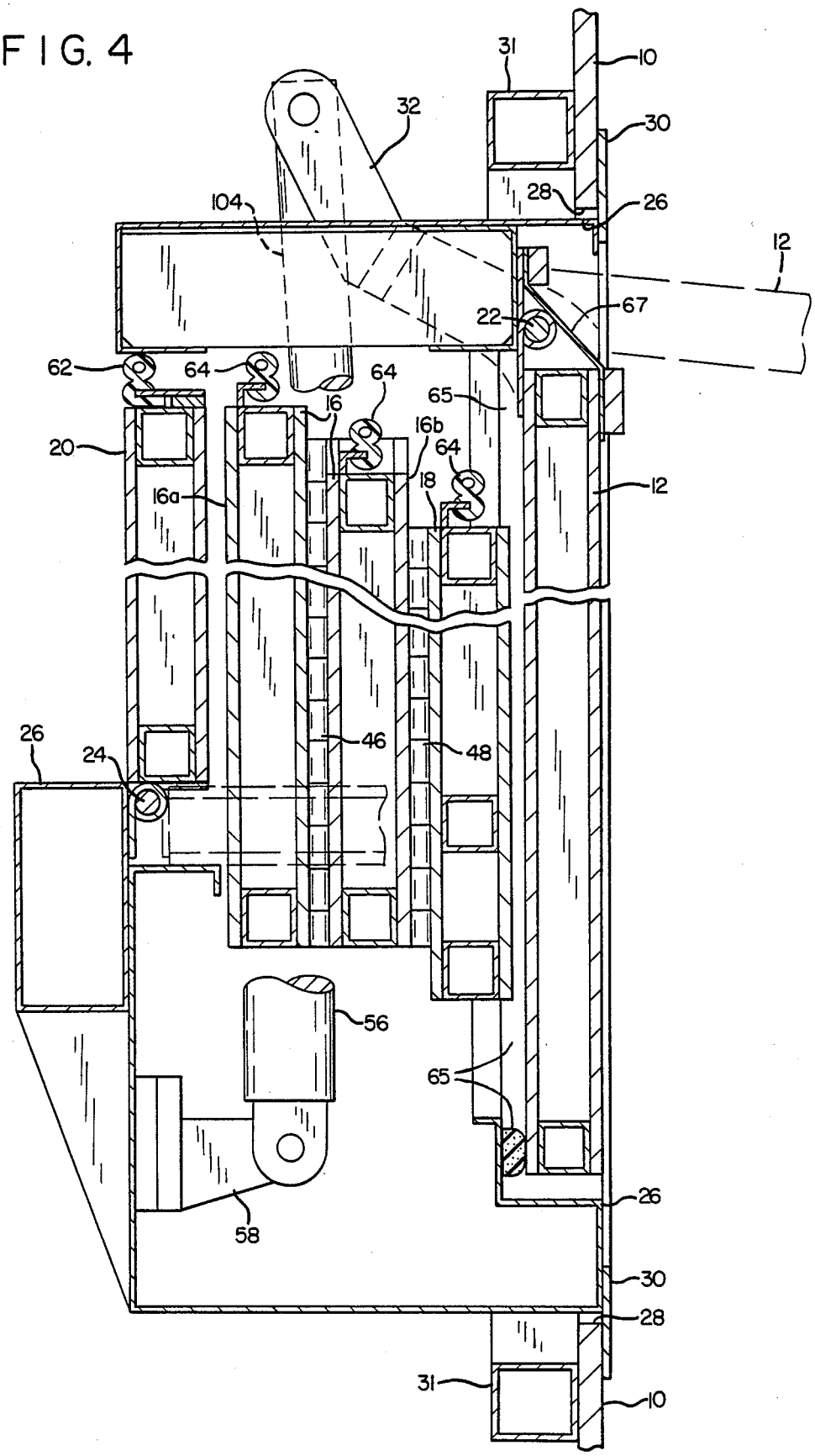
FIG. 4 is a section view of the module as taken on view lines 4—4 of FIG. 1.

As will be noted from FIGS. 1 and 4, the walls, roof and floor are in a stacked condition with wall/roof 12 on the outside and adapted to pivot outwardly around pivot 22. Side wall 18 is positioned immediately behind wall/roof 12. Side wall 18 is hingedly connected to the outer ends of bi-fold end wall section 16 (See also FIG. 6). The bi-fold wall sections 16*a*, 16*b* are stacked immediately behind side wall 18. The sections 16*a*, 16*b* are hingedly connected together and section 16*b* is pivotally connected at its inner end to the modular frame to be later explained. Floor 20 is stacked behind the end walls for pivoting outwardly and downwardly around pivot 24. The arrangement and operation of the various pivots and hinged connections will be explained in more detail in a later section. At this point, the reader must only understand the sequence of operations for expanding the add on room 14.

Figure 5:
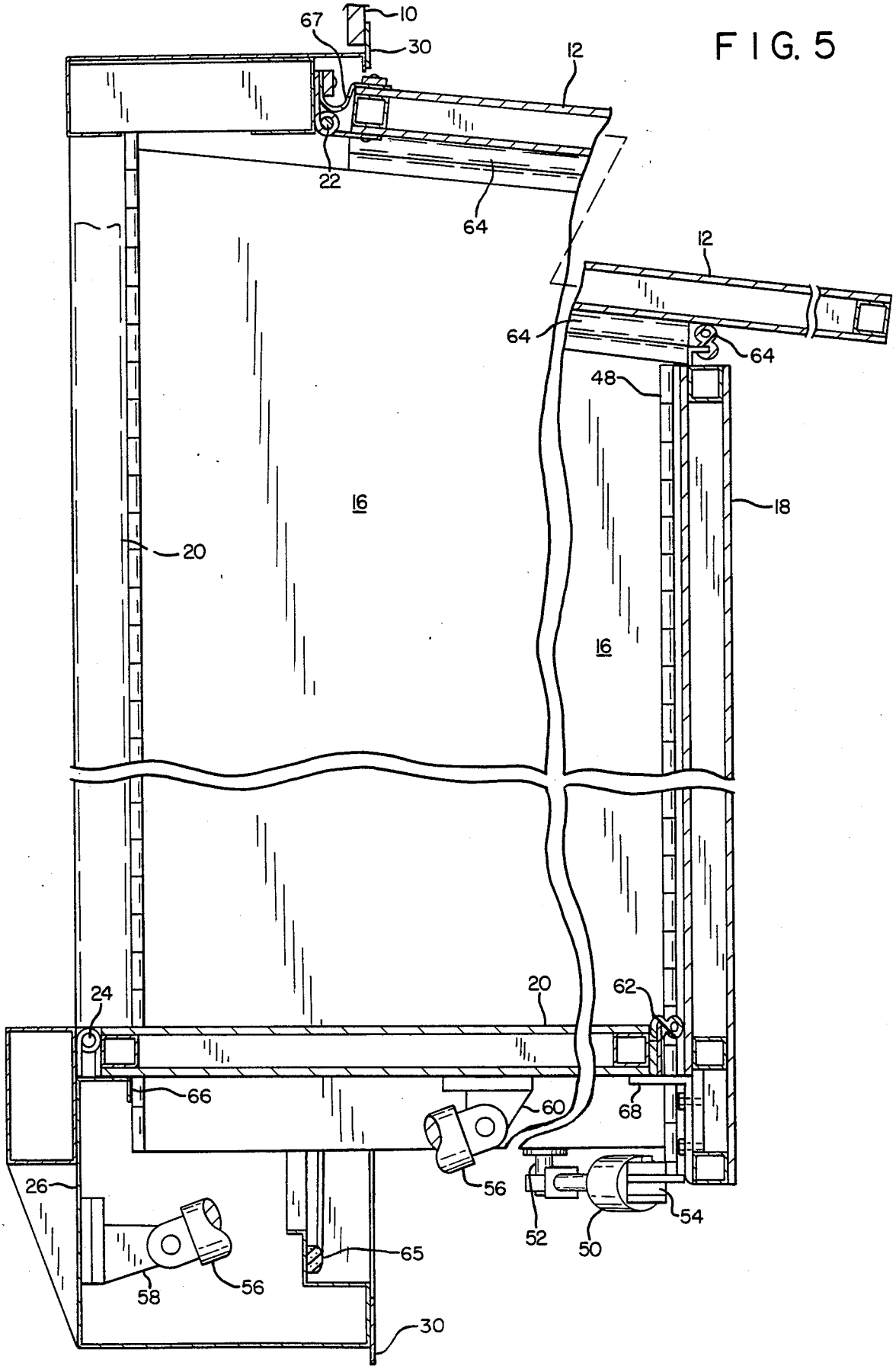
FIG. 5 is a view similar to FIG. 4 but showing the module in its expanded condition.

The opened condition is shown in FIG. 5. Basically, the first operation in the sequence is the lifting of wall-/roof 12 by pivoting it around pivot 22. The second operation is to unfold the bi-fold end walls 16 which has the effect of also pushing out side wall 18. The third operation is to lower the floor 20 around its pivot 24.

The above general organization of stacked walls (including floor and roof) and the sequence of deploying these walls is not new to the present invention. They are disclosed in the commonly assigned U.S. patents mentioned above. The present invention is directed to an improvement over these patents. More specifically, it is the provision of a unitized module which incorporates all of the above-described walls and the operational components that deploy and retract those walls. The unitized construction renders the adaptability of the concept to existing structures (such as panel trucks) considerably more simple. A customizing house can simply purchase the module, cut an opening in the side wall of a panel truck, insert and secure the module in the opening, connect a couple of wires and the job is done. The preferred embodiment of this self contained module will now be explained.

Reference is made to FIG. 1 which illustrates the concept of the invention, i.e. a unitized module as shown in its pre-assembled condition and in the process of being installed in the wall of the panel truck. The module includes a configured frame 26 that surrounds the module. The frame 26 is configured so as to house and support the walls and operating apparatus for the add on room, and also is adapted to fit a properly dimensioned rectangular cut out 28 in wall 10 of the illustrated van.

The fitting of the frame 26 to the wall 10 is quite simply accomplished and can be most clearly appreciated from FIG. 4 which the reader will recall is a section view from FIG. 1. A facing flange 30 is welded or otherwise secured to the frame 26 and with the frame 26 in place in the cut out 28, the flange 80 abuts the edge of the wall 10 surrounding the opening 28 therein. The flange 30 is then butt welded, bolted or otherwise strongly secured to the wall 10. The support beams 31 which are shown in FIG. 4, backing the wall 10, are typically provided in such wall structure but, of course, may be added as desired to insure a solid support for the facing flange 30.

The arrangement of the operating apparatus is illustrated in FIG. 1. Details of this apparatus are found in further drawings which will be referred to throughout the description.

Referring also to FIG. 4, at each of the hinged corners of the wall/roof 12 is a bracket 32 that is attached at one end thereof to the side edge of wall/roof 12 and at the other end to the piston 104 of an electrically actuated screw-type motor 34. The bracket 32 is pivoted at pivot 22 and thus actuation of the motors 34 to extend or shorten piston 104, forces closing and opening of the wall/roof 12.

The unfolding of the side wall 18 and bi-fold end wall 16 is accomplished by a second pair of motors 36. (See FIGS. 1 and 6 and note that FIG. 6 is a sectional view of FIG. 2.) A bracket 38 is mounted to the bottom rail of the frame 26. A pivot 40 is provided on the bottom edge of the inner section **16*a* of bi-fold end wall 16. The cylinder and piston of motor 36 (not shown in FIG. 6 but represented by dash lines and similar in operation to motor 34) is connected at its ends to bracket 38 and pivot 40. It will be understood that only one of the bi-fold end walls 16 is shown in FIG. 6 and that the other bi-fold end wall 16 is unfolded in the same manner with similar apparatus. Upon extension of the motors 36, the inner section 16*a* of the bi-fold walls 16 are pivoted around vertical pivots 42 which attaches the end wall sections to a vertical beam 44 carried by the frame 26**.

The outer section **16*b* of bi-fold end wall 16 is attached at its inner edge to the outer edge of the inner section 16*a*, i.e. at pivot 46. This outer section 16*b* of bi-fold end wall 16 is also attached at its outer edge to one side edge of side wall 18, i.e. at pivot 48. Side wall 18 is, of course, attached to the outer sections 16*b* of both bi-fold end walls 16 and thus as the two inner sections 16*a* of bi-fold end walls 16 are pivoted, the combination of the two end walls 16 and inter-connected side wall 18 is expanded in unison outwardly, i.e. from the dash position shown in FIG. 6** to the solid line position.

Figure 7:
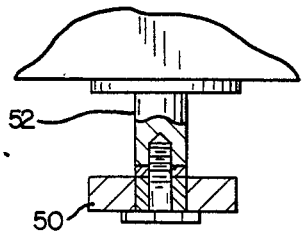
FIG. 7 is a section view as taken on view lines 7—7 of FIG. 6.

The arrangement and operation described above for unfolding the end walls and side walls will achieve the indicated fully collapsed and fully extended positions that are indicated. During the process of simultaneous pivoting of the various components that make up the end walls and side wall and the deployment thereof, the structure can be unwieldy or at least give that appearance. It is believed desirable, but not necessary, to provide air cylinders 50 (sometimes referred to as eveners) that extend from a pivotal connection 52 under the outer section **16*b* of end walls 16 (see FIG. 7) to a bracket 54 attached to the bottom end of side wall 18 (see FIG. 5**). The air cylinders force a steady unfolding movement and prevent uncontrolled "flapping" as between the end wall and side wall when in the partially opened or closed condition.

With the wall/roof 12 raised and the end walls 16 and side wall 18 unfolded, the next operation is the lowering of the floor 20, most clearly illustrated in FIGS. 4 and 5 and generally illustrated in FIG. 1. It, too, is controlled by a screw type cylinder/piston motor 56 (but a single motor) similar in operation to motors 34 and 36. As will be seen in FIG. 1, the motor 56 is positioned on the bottom side of floor 20 and in the folded or collapsed position is nested between the bi-fold end walls 16. In the collapsed position the wall/roof 12 is sealed against the frame 26 by a flexible web 67 extended over pivot 22 at the top of the wall/roof and by pads 65 extended along the sides and bottom of the frame 26.

A bracket 58 is mounted to the bottom rail of frame 26 and a bracket 60 is mounted to the bottom side of floor 20. Motor 56 extends between these brackets. With the piston of the motor 56 extended as is the case in FIG. 4, the floor 20 is forced into its vertical or stored position and when retracted as in FIG. 5, the floor 20 is forced into its horizontal or extended position.

With the floor 20 in place, the end wall 16 and side wall 18 are properly positioned and the wall/roof 12 is then lowered onto the side wall 18 as illustrated in FIG. 5. Sealing pads 62 are attached to the outside edge of floor 20 on the exposed sides thereof for sealing against the end walls 16 and side wall 18. Sealing pads 64 are attached to the top edges of side wall 18 and end walls 16 for sealing against the wall/roof 12. As will be particularly noted in FIG. 5, the floor 20 is supported in its lowered position by flange 66 provided from frame 26 and flange 68 carried along the bottom inside edge of side wall 18.

The final operation is the setting of stabilizers which are mounted in corner posts 72 provided at the side edges of side wall 18. These stabilizers and their operation are illustrated in FIGS. 1, 2 and 8. FIGS. 1 and 8 show the stabilizing legs 70 in retracted position and FIG. 2 in the extended position. The legs 70 of the stabilizers are square tubes that are prevented from rotation within posts 72 by bearing pads 74 (FIG. 8). A base plate 76 is welded to the bottom end of legs 70 as shown.

From FIG. 8, the inner end of legs 70 carry a nut 78 that is secured to the leg 70 by pins 79 as illustrated. A long threaded shaft 80 is threadedly engaged with the nut 78. The upper end 82 of the shaft 80 is contained in a bushing structure 84. An electric motor 86 functions to rotate the shaft 80. By rotating the shaft 80 clockwise and counter clockwise, leg 70 is forced down or up on the shaft 80 and is thus extended or retracted.

Operation

As emphasized throughout the above description, the invention herein resides in the manner of assembling the walls and the control apparatus therefor to provide a unitized structure separate from the core structure. The unitized structure as differentiated from the core structure virtually houses the entire add on room. A wall 10 (any wall 10) with sufficient size can be provided with the appropriate opening 28 which will allow insertion and attachment of the frame 26 of the unitized structure. With such attachment, assembly is complete.

Whereas all of the operating motors are described as being electric, it is not intended that the invention be limited to electric motors. Such motors are, however, readily available and easily packaged within the configuration of the frame 26.

Whereas electronic controls are important to the satisfactory operation of the apparatus, such controls can be readily acquired from electrical system designers having access to the schematics illustrated in FIGS. 9 and 10. These controls will be generally referred to in the operational description that follows. Reference is made primarily to drawings 3, 9 and 10.

The control panel 88 (FIG. 3) is mounted in the cab of the panel truck of FIGS. 1 and 2 for easy access by the truck operator. A master switch 90 is provided for turning power on or off to the system. Once the power is on, the operator simply engages in sequence the appropriate operating switches 92–102. Switch 92 raises or lowers the roof 12, switch 94 moves the walls 16 and 18 in or out, and switch 96 raises or lowers the floor 20. The stabilizer legs 70 are raised or lowered individually as provided by selection of the left or right stabilizer by activating one of switches 98 or 100 and then activating switch 102.

Reference is now made to FIGS. 9 and 10 and it will be assumed that the operator desires to deploy the add on room from its collapsed position. (Match up from the operating switches 92 through 102 shown in FIG. 9 to the operating mechanism shown schematically in FIG. 10 is provided through panel 110.) Switch 90 is turned on. Switch 92 is engaged and motors 34 are energized through lines 1–4 on panel 110, to force retraction of the pistons 104 into the cylinders 106 thereby raising the wall/roof 12 to a position above the projected location of side wall 18. Motors 34 are then de-energized and switch 94 engaged to energize motors 36 through lines 5, 6, 7 and 8 on panel 110. The pistons 104 of motors 36 are extended until reaching full extension of the walls, at which point motors 36 are de-energized. Switch 92 is then engaged to energize Motor 56 through lines 9 and 10 which forces retraction of the piston 104 of motor 56 and thus lowering of the floor 20. The floor is sealed against the end walls due to sealing engagement of seals 62.

Switch 92 is then moved to the down position so that wall/roof 12 is sealed against walls 16 and 18 due to sealing engagement of seals 64. Switches 98, 100 and 102 are then moved as desired for activating motors 86 through lines 11 through 14, to thereby selectively lower the stabilizer legs 70. It will be noted from FIG. 7 that the add on room 14 is sealed between the wall sections by seals 112 between end wall sections 16*a*, 16*b* and by seals 114 between end wall section 16*b* and side wall 18.

The above is the preferred embodiment as presently contemplated. Others skilled in the art will undoubtedly conceive of various modifications and changes but without departing from the scope of the invention. Accordingly, the invention is to be considered broadly as defined in the claims appended hereto.

I claim:

1. A unitized module housing a collapsible-expandable room addition adapted to fit the wall of an existing core structure, comprising;

a frame having configured upper, lower and side beams defining the top, bottom and sides of the frame, and further having a determined front-to-back dimension and thereby an inner side of the frame and an outer side of the frame, said frame adapted to fit a cut out in the wall of the core structure with the frame's outer side substantially coplaner with the wall, and attachment means for securing the frame to the wall whereby the frame becomes an inset of the wall, a plurality of add on wall members including a wall-/roof, a floor, a side wall and a pair of end walls, said add on wall members having a collapsed condition where the wall members are vertically stacked and as vertically stacked are fitted within the confines of the surrounding beams of the frame, said wall/roof pivotally attached at its upper edge to the frame to pivot on a horizontal axis adjacent the upper beam and on the outer side of the frame, said floor pivotally attached at its lower edge to the frame to pivot on a horizontal axis adjacent the lower beam and on the inner side of the frame, said end walls pivotally attached to the frame at a side edge of each end wall to pivot on a vertical axis adjacent to the respective side beams and intermediate the inside and outside of the frame, and a plurality of motor means for controlling pivotal movement of the wall/roof, floor and end walls, said motor means pivotally mounted to the frame, said configured beams being compatible with the mounting of the motor means whereby, in the collapsed condition, the motor means are substantially housed within the confines of the frame.

2. A unitized module as defined in claim 1 wherein the end walls are bi-fold wall sections that fold together in the collapsed condition between the floor and the wall/roof, a gap is provided between the bi-fold end wall sections when collapsed to define a center cavity, said motor means for controlling pivoting of the floor being housed in part within said cavity in the collapsed condition.

3. A unitized module as defined in claim 2 wherein the side wall is pivotally attached to the opposite edge of both end walls whereby simultaneous pivotal unfolding of the bi-fold end walls forces lateral movement of the side wall, eveners connected between each end wall and the side wall stabilize the walls during the unfolding operation.

4. A unitized module as defined in claim 1 wherein the side wall includes tubular corner posts at each side edge, stabilizing legs are telescopically mounted in the corner posts to be extended from the side walls to the support surface supporting the core structure, and motor means for extending and withdrawing the stabilizing legs.

5. A unitized module as defined in claim 1 wherein the motor means are electrically operated, and including a control panel exposed for manual operation, switches provided on the control panel are electronically connected to the motor means, said switches upon manual operation in the proper sequence, sequentially unfolding and expanding the wall members into an add on room.

* * * * *